United States Patent [19]

Hammerl

[11] Patent Number: 4,814,952

[45] Date of Patent: Mar. 21, 1989

[54] LIGHTING DEVICE FOR AN OVEN CAPABLE OF BEING ACTED UPON BY MICROWAVE ENERGY, IN PARTICULAR A HOUSEHOLD OVEN

[75] Inventor: Günter Hammerl, Bad Reichenhall, Fed. Rep. of Germany

[73] Assignee: Bosch-Siemens Hausgeräte GmbH, München, Fed. Rep. of Germany

[21] Appl. No.: 134,927

[22] Filed: Dec. 18, 1987

[30] Foreign Application Priority Data

Dec. 18, 1986 [DE] Fed. Rep. of Germany ..... 3643364

[51] Int. Cl.[4] ..... F21V 33/00

[52] U.S. Cl. ..... 362/92; 313/271; 219/10.55 R

[58] Field of Search ..... 219/10.55 R, 10.55 E, 219/10.55 D; 362/92, 94, 226; 315/3, 5, 39; 313/271, 318; 126/273 R, 375 E, 19 R

[56] References Cited

U.S. PATENT DOCUMENTS 3,543,078 11/1970 Steinhart et al. ..... 313/318

4,254,450 3/1981 White et al. ..... 362/92

4,559,585 12/1985 Almgren et al. ..... 362/92

*Primary Examiner*—Samuel Scott

*Assistant Examiner*—Noah Kamen

*Attorney, Agent, or Firm*—Herbert L. Lerner; Laurence A. Greenberg

[57] ABSTRACT

An oven has a baking space wall at least partly defining a closed baking chamber to be acted upon by microwave energy with a given basic microwave frequency capable of being radiated into the baking space with a given wavelength. A lighting device for the oven includes a bulb holder, an incandescent bulb mounted on the bulb holder and protruding freely into the baking space from the baking space wall without electromagnetic shielding, and electrical connection lines supplying the incandescent bulb with current from outside the baking chamber. The incandescent bulb has a glass bulb, incandescent filament holders of equal length extending substantially, parallel and alongside one another, and an incandescent filament disposed between ends of the incandescent filament holders in the glass bulb. The filament has a longitudinal extension within which all spacings between given points along the incandescent filament are equivalent to a maximum of 10% of the given wavelength.

12 Claims, 2 Drawing Sheets

LIGHTING DEVICE FOR AN OVEN CAPABLE OF BEING ACTED UPON BY MICROWAVE ENERGY, IN PARTICULAR A HOUSEHOLD OVEN

BACKGROUND OF THE INVENTION

Description of the Related Art

The invention relates to a lighting device for an oven, in particular a household oven, the closed baking chamber of which can be acted upon by microwave energy, including an incandescent bulb mounted on a bulb holder and supplied with current from outside the baking chamber through electrical connection lines.

In microwave ovens or microwave stoves with or without additional thermal heat sources, lighting devices having incandescent filament bulbs are used for lighting the baking chamber. In such devices, the bulbs are typically disposed on the wall of the baking chamber in the vicinity of one of the side walls or the upper wall of the baking chamber. As is well known in this connection, a relatively large opening must be provided in the baking chamber wall, behind which the lamp base of the lighting device is secured outside the oven space. Special means must be made in this vicinity in order to prevent the escape of microwaves through the openings. Furthermore, the fact that the incandescent bulbs with the incandescent filaments and incandescent filament holders thereof act as receiving antennae for microwave energy radiated into the baking space must also be taken into account. Among other effects, the voltages induced in such lighting systems generate currents which cause current to flow over the incandescent filaments. The incandescent coils of prior art lighting devices can and are made to become incandescent, solely due to the action of these currents. If these currents are superimposed on the currents supplied for purposes of continuous illumination, then the typical incandescent bulbs which are used would be rapidly destroyed by the overload The electromagnetic microwave field moves around within the baking space, among other reasons for the sake of attaining the most uniform possible exposure to microwaves in the baking chamber. However, at least in the prior art lighting devices that are exposed to microwave energy, this causes the incandescent bulb to light up intermittently, which is annoying. For these reasons, it is the usual practice to provide ways of preventing or at least of reducing microwave energy from being radiated onto the incandescent bulb of the lighting device. The most often used means of protection shade the lighting device from the space acted upon by microwave energy with a so-called perforated screen formed of metal material. Since the incandescent bulbs should be accessible and capable of being changed from inside the baking space, especially in built-in appliances, the perforated screen must be detachably secured on the baking space wall, which once again presents problems in terms of microwave shielding. Furthermore, a particular disadvantage is the fact that the perforated screen sharply reduces the luminous efficiency. In order to adequately light the baking space, correspondingly powerful bulbs must be used, which in turn present additional problems because of their pronounced heat buildup.

It has also already been proposed to shift the incandescent bulbs back behind the baking space wall, and to form the socket shaft for the incandescent bulb in the form of so-called microwave traps. This structure once again meets with considerable difficulties in practical utilization and the incandescent coil that is shifted out of the baking space again leads to reduced luminous efficiency.

It is accordingly an object of the invention to provide a lighting device for an oven capable of being acted upon by microwave energy, in particular a household oven, which overcomes the hereinafore-mentioned disadvantages of the heretofore-known devices of this general type and which assures good illumination of a baking space that is capable of being acted upon by microwave energy without the above-described unfavorable secondary effects resulting from the action of microwave properties.

SUMMARY OF THE INVENTION

With the foregoing and other objects in view there is provided, in accordance with the invention, in an oven, especially a household oven, having a baking space wall at least partly defining a closed baking chamber to be acted upon by microwave energy with a given basic microwave frequency capable of being radiated into the baking space with a given wavelength, the improvement comprising a lighting device for the oven including a bulb holder, an incandescent bulb mounted on the bulb holder and protruding freely into the baking space from the baking space wall without electromagnetic shielding, electrical connection lines supplying the incandescent bulb with current from outside the baking chamber, the incandescent bulb having a glass bulb, incandescent filament holders of equal length extending substantially parallel and alongside one another, and an incandescent filament disposed between ends of the incandescent filament holders in the glass bulb, the filament having a longitudinal extension within which all spacings between given, selected or arbitrary points along the incandescent filament are equivalent to a maximum of 10% of the given wavelength.

In accordance with another feature of the invention, the baking space wall, from which the incandescent bulb protrudes into the baking space, is substantially flat.

In accordance with a further feature of the invention, the incandescent bulb is a low-voltage bulb having a connected load of a maximum of 30 volts.

In accordance with an added feature of the invention, the incandescent bulb is a low-voltage bulb having a connected load of 12 volts.

In accordance with an additional feature of the invention, the incandescent bulb is a halogen lamp. This is done in order to attain high luminous efficiency with small dimensions.

In accordance with yet another feature of the invention, the incandescent filament holders of the incandescent bulb and given, selected or arbitrary points along the incandescent coil of the incandescent bulb are spaced apart from one another by a maximum distance of 1/16 of the given basic microwave frequency.

In accordance with yet a further feature of the invention, the incandescent bulb has a base or glass base, and the incandescent filament holders of the incandescent bulb extend through the base in the form of connection plug prongs.

In accordance with yet an added feature of the invention, the baking space wall is formed of metal and has a side facing the baking space, the bulb holder is disposed on the side of the baking space wall facing the baking space, the connection wires extend through duct holes formed in the baking space wall, and the connection wires have a shielding jacket being grounded to the metal baking space wall.

Typically and suitably, the supply of current to the incandescent bulbs comes from a public utility grid with the corresponding voltages, such as 220V. These voltages must be transformed for the bulbs used in accordance with the invention which have lower connected load voltages To this end, conventional transformers are preferably used, having an intrinsic inductance which counteracts the remaining slight energy absorbed by the incandescent bulb with a practically infinitely high resistance. This prevents a more extensive flow of current which could be returned by the microwave radiation to the incandescent bulb located in the baking space, through the connection lines for the incandescent bulb.

In accordance with yet an additional feature of the invention, the baking space wall has a side facing away from the baking space, the bulb holder is disposed on the side of the baking space wall facing away from the baking space, and the connection prongs of the incandescent bulb are inserted through duct holes formed in the baking space wall into the bulb holder.

In accordance with again another feature of the invention, there is provided an electromagnetic transformer through which the connection lines are connected to a current supply.

In accordance with a concomitant feature of the invention, there is provided a glass hood covering the incandescent bulb with respect to the baking space. This is done on order to provide mechanical protection against unintentionally touching and affecting the lighting device.

By using an incandescent bulb in accordance with the features of the invention and in particular in accordance with the features further defining the invention, a lighting device is provided which no longer presents any substantial problems with respect to the microwave tightness of the baking space relative to the surroundings thereof. The structure and dimensions of the incandescent filament holders and the incandescent filament in particular, insure that the antenna effect of the incandescent bulb is negligibly small in terms of receiving the microwave energy radiated into the microwave space. Since the resistances of the incandescent filaments in bulbs having low connected load voltages are also low, any currents induced in the bulb structure can be compensated for without difficulty therein as well, without disadvantageously affecting the incandescent filament. The ducts passing through the baking space wall therefore need have only the diameter of the shielded current supply connections, which does not present any difficulties in terms of manufacture or of assuring microwave tightness. The disposition of the incandescent bulb inside the baking space without a metal shielding screen surrounding it also has the advantage of making the total illuminating force of the incandescent bulb available inside the baking space. The connected power value for the incandescent bulbs can thus be lowered and the power losses which have the effect of dissipated heat, are reduced substantially as compared with shielded bulbs. If halogen lamps are used, a bright white light is furnished.

Other features which are considered as characteristic for the invention are set forth in the appended claims.

Although the invention is illustrated and described herein as embodied in a lighting device for an oven capable of being acted upon by microwave energy, in particular a household oven, it is nevertheless not intended to be limited to the details shown, since various modifications and structural changes may be made therein without departing from the spirit of the invention and within the scope and range of equivalents of the claims The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
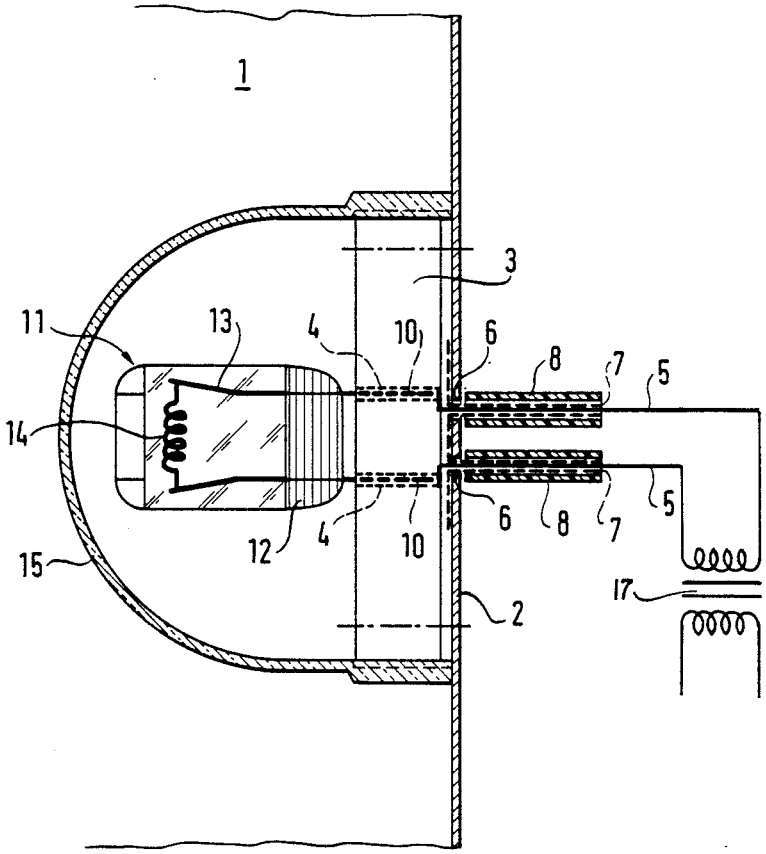
FIGS. 1–3 are fragmentary, diagrammatic, cross-sectional views of three different embodiments of lighting devices disposed on a wall of a baking space and protruding into the baking space of a household oven capable of being acted upon by microwave energy.

Referring now to the figures of the drawings in detail and first, particularly, to FIG. 1 thereof, there is seen a household oven having a baking space or chamber 1 which is capable of being acted upon by microwave energy and is surrounded on all sides by baking space walls and a baking space door. The only part of the oven that is shown in the drawing is the vicinity of a partial section of a baking space wall 2 which is shown in section, in which the lighting device for the baking space is disposed. A bulb holder 3 formed of electrically insulating material is secured to the partial section of the baking wall 2. Connection lines 5 lead from female plugs 4 of the bulb holder 3 to a current supply device, which is a transformer 17. The connection lines 5 are surrounded by insulation and protrude through duct openings 6 passing through the baking space wall 2. The connection lines 5 have a metal shielding jacket 7 in the vicinity of the duct openings 6 and adjacent thereto, which also extends between the bulb holder 3 and the baking space wall 2. The metal shielding jacket 7, grounded to the metal baking space wall, prevents a major dissipation of microwave energy out of the baking space 1 through the duct holes 6. In this way, the required microwave tightness in this vicinity is accordingly provided. An insulating tube 8 is slipped over each metal shielding jacket 7.

Connection plug prongs 10 of a halogen lamp 11 inserted into the female plugs 4 of the bulb holder 3. The connection prongs 10 are extended through a glass base 12 of the halogen lamp 11 in the form of incandescent filament holders 13, which are substantially parallel to one another. A coiled incandescent filament 14 is fastened between free ends of the incandescent filaments holders 13 inside the glass bulb of the halogen lamp 11.

The spacing between the connection plug prongs 10 and the incandescent filament holders 13 amounts to approximately 4 mm, while the length of the incandescent coil 14 amounts to approximately 6 mm. The connection voltage for the halogen lamp is 12 volts. Since the halogen lamp 11 protrudes freely into the baking space, a connection power of 5 watts can be sufficient.

The halogen lamp is covered with respect to the baking space 1 by a glass hood 15, in order to protect the halogen lamp 11 from being unintentionally touched and damaged.

Figure 2:
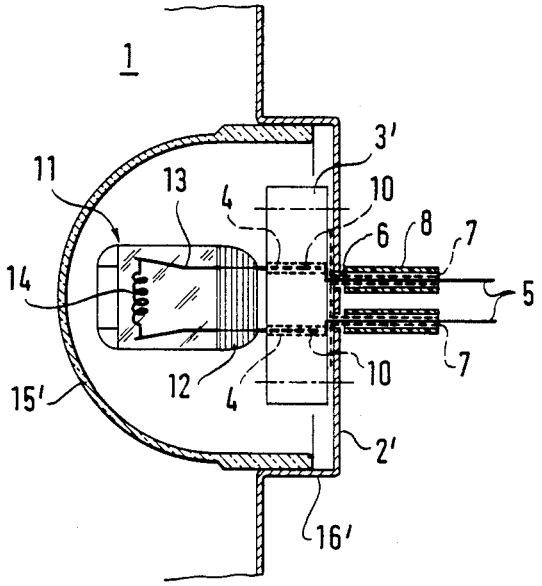
Figure 3:
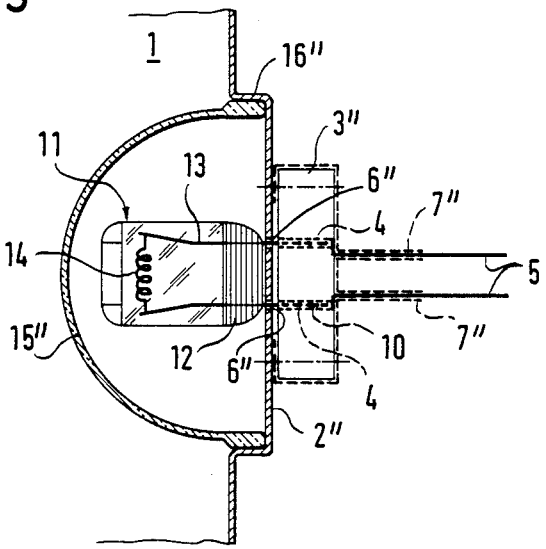

The embodiments of FIGS. 2 and 3 vary in terms of the disposition of bulb holders 3' and the incandescent bulb 11 relative to baking space walls 2' and 2''. The baking space walls 2' and 2'' have protrusions or bulges 16' and 16'' in the vicinity of the bulbs and the lamp holders which extend from the baking space 1. Glass hoods 15' and 15'' are detachably secured by using conventional means in the indentations of the baking space walls 2' and 2'' formed by the protrusions. In FIG. 2, the bulb holder 3' is disposed on the side of the baking space wall 2' facing toward the baking space 1, and in FIG. 3 it is disposed on the side of the baking space wall 2'' facing away from the baking space 1. In the FIG. 3 embodiment, the connection prongs 10 of the incandescent bulb 11 protrude through two holes 6'' in the baking space wall 2'' into the bulb holder 3''. The shield 7'' is wrapped around the holder up to the baking space wall 2''.

I claim:

1. In an oven having a baking space wall at least partly defining a closed baking chamber to be acted upon by microwave energy with a given basic microwave wavelength capable of being radiated into the baking space with a given wavelength, the improvement comprising a lighting device for the oven including a bulb holder, an incandescent bulb mounted on said bulb holder and protruding freely into the baking space from the baking space wall without electromagnetic shielding, electrical connection lines supplying said incandescent bulb with current from outside the baking chamber, said incandescent bulb having a glass bulb, incandescent filament holders of equal length extending substantially parallel and alongside one another, and an incandescent filament disposed between ends of said incandescent filament holders in said glass bulb, said filament having a longitudinal extension within which spacings between any two given points along said incandescent filament are no more than 10% of the given microwave wavelength.

2. Lighting device according to claim 1, wherein the baking space wall, from which said incandescent bulb protrudes into the baking space, is substantially flat.

3. Lighting device according to claim 1, wherein said incandescent bulb is a low-voltage bulb having a connected load of a maximum of 30 volts.

4. Lighting device according to claim 3, wherein said incandescent bulb is a low-voltage bulb having a connected load of 12 volts.

5. Lighting device according to claim 4, wherein said incandescent bulb is a halogen lamp.

6. Lighting device according to claim 3, wherein said incandescent bulb is a halogen lamp.

7. Lighting device according to claim 3, wherein said incandescent filament holders of said incandescent bulb and given points along said incandescent coil of said incandescent bulb are spaced apart from one another by a maximum distance of 1/16 of the given basic microwave frequency.

8. Lighting device according to claim 1, wherein said incandescent bulb has a glass base, and said incandescent filament holders of said incandescent bulb extend through said glass base in the form of connection plug prongs.

9. Lighting device according to claim 8, wherein the baking space wall has a side facing away from the baking space, the bulb holder is disposed on the side of the baking space wall facing away from the baking space, and said connection prongs of said incandescent bulb are inserted through duct holes formed in the baking space wall into said bulb holder.

10. Lighting device according to claim 1, wherein the baking space wall is formed of metal and has a side facing the baking space, said bulb holder is disposed on the side of the baking space wall facing the baking space, said connection wires extend through duct holes formed in the baking space wall, and said connection wires have a shielding jacket being grounded to the metal baking space wall.

11. Lighting device according to claim 1, including an electromagnetic transformer through which said connection lines are connected to a current supply.

12. Lighting device according to claim 1, including a glass hood covering said incandescent bulb with respect to the baking space.

* * * * *